US008651899B2

(12) United States Patent
Sartori et al.

(10) Patent No.: US 8,651,899 B2
(45) Date of Patent: Feb. 18, 2014

(54) LAMP SOCKET ASSEMBLY AND METHOD

(75) Inventors: Marco Antonio Sartori, Santo Andre (BR); Ednei Lopes, Braganca Paulista (BR); Jose Roberto Goldschmidt, Campinas (BR)

(73) Assignee: Tyco Electronics Brasil LTDA, Sao Paulo (BR)

( * ) Notice: Subject to any disclaimer, the term of this patent is extended or adjusted under 35 U.S.C. 154(b) by 111 days.

(21) Appl. No.: 13/248,136

(22) Filed: Sep. 29, 2011

(65) Prior Publication Data

US 2013/0084727 A1 Apr. 4, 2013

(51) Int. Cl.
*H01R 24/00* (2011.01)

(52) U.S. Cl.
USPC ..... 439/699.2; 439/336; 439/596

(58) Field of Classification Search
USPC ..... 439/142, 596, 581, 335, 336, 699.2, 439/902, 918
See application file for complete search history.

(56) References Cited

U.S. PATENT DOCUMENTS

| | | | | |
|---|---|---|---|---|
| 4,752,241 | A | 6/1988 | Matsuoka et al. | |
| 4,995,830 | A * | 2/1991 | Eckhaus | 439/409 |
| 5,000,702 | A | 3/1991 | Forish et al. | |
| 5,501,618 | A | 3/1996 | Muta et al. | |
| 5,509,828 | A | 4/1996 | Muta et al. | |
| 5,895,283 | A * | 4/1999 | Takanashi | 439/336 |
| 6,080,019 | A | 6/2000 | Coushaine | |
| 6,270,235 | B1 | 8/2001 | Coushaine | |
| 6,710,526 | B1 | 3/2004 | Helbig | |
| 7,083,476 | B2 | 8/2006 | Helbig et al. | |

* cited by examiner

*Primary Examiner* — Khiem Nguyen

(57) ABSTRACT

A lamp socket assembly and method of assembly. The lamp socket assembly includes an opening which extends through a wall of the housing to a terminal receiving cavity. A first terminal and a second terminal are positioned in the housing. The first terminal has a first lamp contact portion and a first contact mating portion. The second terminal has a second lamp contact portion and a second contact mating portion. A cover is positioned over the opening. The cover cooperates with the housing to isolate the first and second terminals from the environmental conditions to which the lamp socket assembly is exposed. The opening is dimensioned to allow the first and second terminals to be inserted therethrough.

15 Claims, 3 Drawing Sheets

LAMP SOCKET ASSEMBLY AND METHOD

FIELD OF THE INVENTION

The present invention is directed to lamp socket assemblies and in particular to lamp socket assemblies such as are used in lights of automobiles and the like.

BACKGROUND OF THE INVENTION

Many lamp socket designs have been provided in the prior art. However, these prior art lamp socket assemblies are generally rather complicated with numerous parts and therefore costly to manufacture and assemble. Not only have such lamp assemblies been rather costly to manufacture, but servicing such assemblies, for instance for replacement of burned out bulbs, can be quite time consuming and may result in failure to properly install the lamp seal with attendant corrosion problems.

Some prior art lamp socket assemblies have used a bayonet type of socket which uses a compression spring to ensure proper contact with the bulb. Such sockets are undesirable as the compression spring causes the socket to have a rather high profile. Still other prior art lamp socket assemblies have sought to achieve a low profile by using potted contact structures. These devices are expensive to construct and furthermore are difficult to service.

Still other prior art lamp socket assemblies have been provided wherein the base of the unit is resilient and forms the seal for the assembly. This type of structure is easily overtorqued and damaged when it is installed in an automobile.

It is therefore desired to provide a lamp socket assembly which is simple in construction and which has a low profile. It is furthermore desired to provide a lamp socket assembly which be manufactured using conventional molding and which minimizes the parts required for assembly.

SUMMARY OF THE INVENTION

An exemplary embodiment of a lamp socket includes a housing having a bulb holding portion and a connector receiving portion. An opening extends through a wall of the housing to a terminal receiving cavity. A first terminal and a second terminal are positioned in the housing. The first terminal has a first lamp contact portion and a first contact mating portion. The second terminal has a second lamp contact portion and a second contact mating portion. A cover is positioned over the opening. The cover cooperates with the housing to isolate the first and second terminals from the environmental conditions to which the lamp socket assembly is exposed. The opening is dimensioned to allow the first and second terminals to be inserted therethrough.

An exemplary embodiment of a lamp socket includes a housing having a bulb holding portion and a connector receiving portion. A first terminal and a second terminal are positioned in the housing. The first contact mating portion has a first mounting projection which extends therefrom. The second terminal has a second lamp contact portion and a second contact mating portion. A terminal receiving portion extends between the bulb holding portion and the connector receiving portion of the housing. An opening extends through a wall of the terminal receiving portion to a terminal receiving cavity. The opening is dimensioned to allow the first and second terminals to be inserted therethrough.

An exemplary method of assembling a lamp socket assembly includes: molding a housing with an opening in a terminal receiving portion of the housing; inserting a first terminal and a second terminal through the opening in the terminal receiving portion of the housing; positioning the first terminal in a first terminal receiving passage of the housing; positioning the second terminal in a second terminal receiving passage of the housing; and positioning a cover over the opening, projections of the cover cooperating with the first terminal and the second terminal to secure the first terminal in the first terminal receiving passage and the second terminal in the second terminal receiving passage.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

In the following detailed description, numerous specific details are set forth in order to provide a thorough understanding of various exemplary embodiments. However, those skilled in the art will understand that the invention may be practiced without these specific details and that the invention is not limited to the depicted exemplary embodiments. In other instances, well known methods, procedures, and components have not been described in detail.

Further, various operations may be described as multiple discrete steps performed in a manner that is helpful for understanding the exemplary embodiments. However, the order of description should not be construed as to imply that these operations need be performed in the order they are presented, or that they are even order-dependent.

The disclosure relates to a lamp socket assembly which is appropriate for use in automotive applications. The assembly is simple in construction, minimizing the parts required for assembly and operation. In addition, the assembly can be manufactured using conventional molding techniques.

Figure 1:
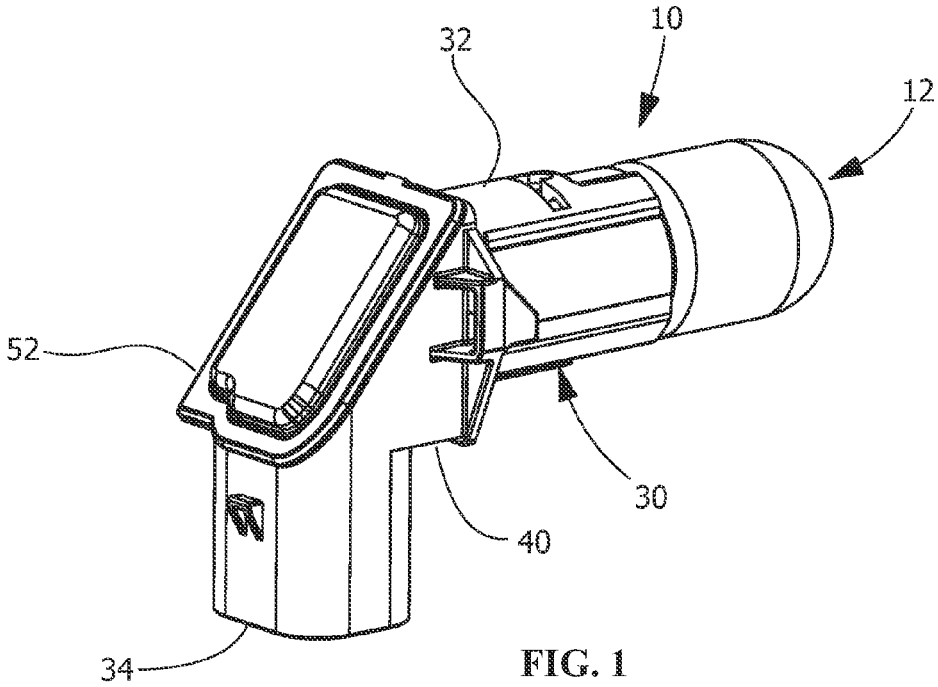
FIG. 1 is a perspective view of an illustrative embodiment of a lamp socket assembly with a bulb inserted therein.

Referring to FIG. 1, an exemplary embodiment of the socket assembly 10 is shown with a halogen incandescent lamp or bulb 12 inserted therein. The lamp or bulb 12 is of the type known in the industry which can be used in an automotive or vehicle headlight, for example for the purpose of producing the lower beam, upper beam or fog light. Bulb 12 has a vitreous lamp vessel 14 (FIG. 2) having a sealed-off conductive end 16 (FIG. 2), which is anchored in the lamp socket assembly 10. While the exemplary embodiment of bulb 12 is shown, other lamps or bulbs may be inserted in the lamp socket assembly 10 without departing from the scope of the claims.

Figure 2:
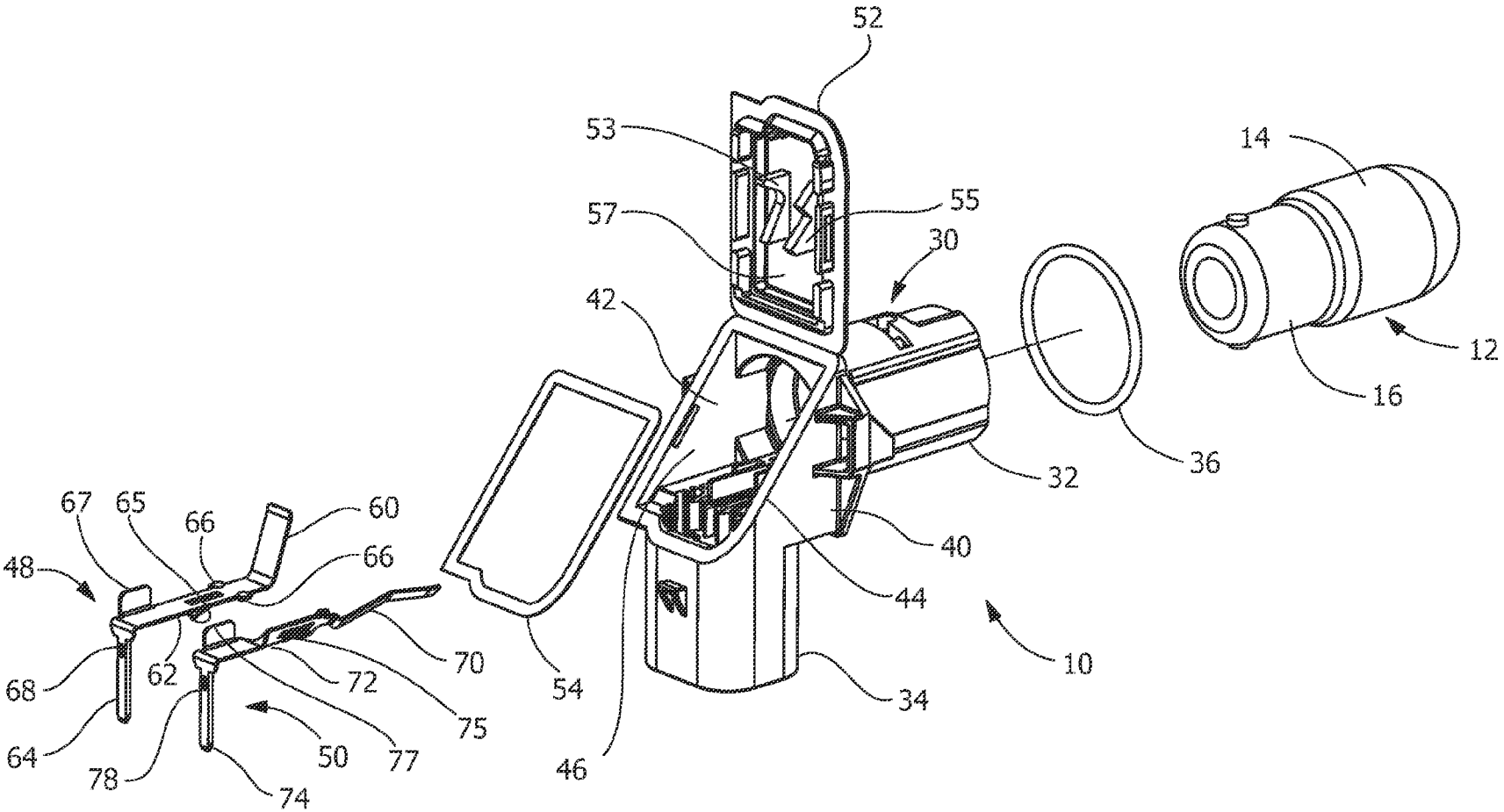
FIG. 2 is an exploded perspective view of the lamp socket assembly of FIG. 1.

As best shown in FIGS. 1 and 2, the lamp socket assembly 10 has a housing 30 which extends from a bulb holding portion 32 to a connector receiving portion 34. The bulb holding portion 32 has a longitudinal axis which is essentially perpendicular to the longitudinal axis of the connector receiving portion 34, although other configuration are possible. A seal or o-ring 36 (FIG. 2) may be provided or positioned on the bulb holding portion 32.

A terminal receiving portion 40 extends between the bulb holding portion 32 and the connector receiving portion 34. The terminal receiving portion 40 has an opening 42 which extends through a wall 44 of the terminal receiving portion 40 to a terminal receiving cavity 46. In the exemplary embodiment shown, the opening 42 extends an angle of approximately 45 degrees to the longitudinal axis of the bulb holding portion 32 and the connector receiving portion 34, although other angles can be used without departing from the scope of the claims.

First and second terminals 48, 50 are positioned in the terminal receiving cavity 46, as will be more fully described. Terminal 48 has a first lamp contact portion 60, a first mounting portion 62 and a first contact mating portion 64. The lamp contact portion 60, in the exemplary embodiment shown, is an angled or curved portion which cooperates with the end 16 (FIG. 2) of the bulb 12 to provide electrical contact therebetween. The longitudinal axis of mounting portion 62 extends in direction which is essentially perpendicular to the longitudinal axis of the contact mating portion 64. However, other configurations of terminal 48 are within the scope of the claims. As best shown in FIG. 2, the mounting portion 62 has mounting barbs or projections 65 and dimples or projections 66 which extend from sides thereof. The mounting barbs/projections 65, 66 may be in the form of a dimple, resilient finger, or any other known type of projection or barb. A tab 67 also extends from the mounting portion 62. A mounting opening 68 is provided in the contact mating portion 64.

Terminal 50 has a second lamp contact portion 70, a second mounting portion 72 and a second contact mating portion 74. The lamp contact portion 70, in the exemplary embodiment shown, has an angled or curved portion which cooperates with a sidewall of the end 16 (FIG. 2) of the bulb 12 to provide electrical contact therebetween. The longitudinal axis of mounting portion 72 extends in direction which is essentially perpendicular to the longitudinal axis of the contact mating portion 74. However, other configurations of terminal 50 are within the scope of the claims. As best shown in FIG. 2, the mounting portion 72 has mounting barb or projection 75. The mounting projection 75 may be in the form of a dimple, resilient finger, or any other known type of projection or barb. A tab 77 also extends from the mounting portion 72. A mounting opening 78 is provided in the contact mating portion 74.

A lid or cover 52 is positioned over the opening 42 (as best shown in FIGS. 1 and 2). A double sided adhesive 54 (FIG. 2) or other known holding mechanism is positioned between the cover 52 and the wall 44 to properly maintain the cover 52 over the opening 42. The cover 52 cooperates with the housing to isolated the terminals 48, 50 from the environmental conditions to which the assemblies 10 are exposed. The cover 52 may be physically attached to the housing 30, by means of a hinge or other similar means. Alternatively, the cover 52 may be a separate component. Projections 53, 55 are provided on an inside surface 57 of the cover 52.

Referring to FIG. 2, terminals 48, 50 are inserted into the terminal receiving cavity 46 of the lamp socket assembly 10. The opening 42 is dimensioned to be large enough to allow the terminals 48, 50 to be inserted therethrough. Once inserted, the terminals 48 and 50 are moved and retained in the positions best shown in FIGS. 4 and 5. The configuration of the housing 30 and opening 42 allows for the housing to be injection molded from plastic or other material having the appropriate strength and insulative characteristics required. The terminals 48, 50 made from conductive material, are inserted into the molded housing, as is described in more detail below. This eliminates the need to overmold the housing over the terminals to embed the terminals in the housing, as is required by several known assemblies.

Figure 3:
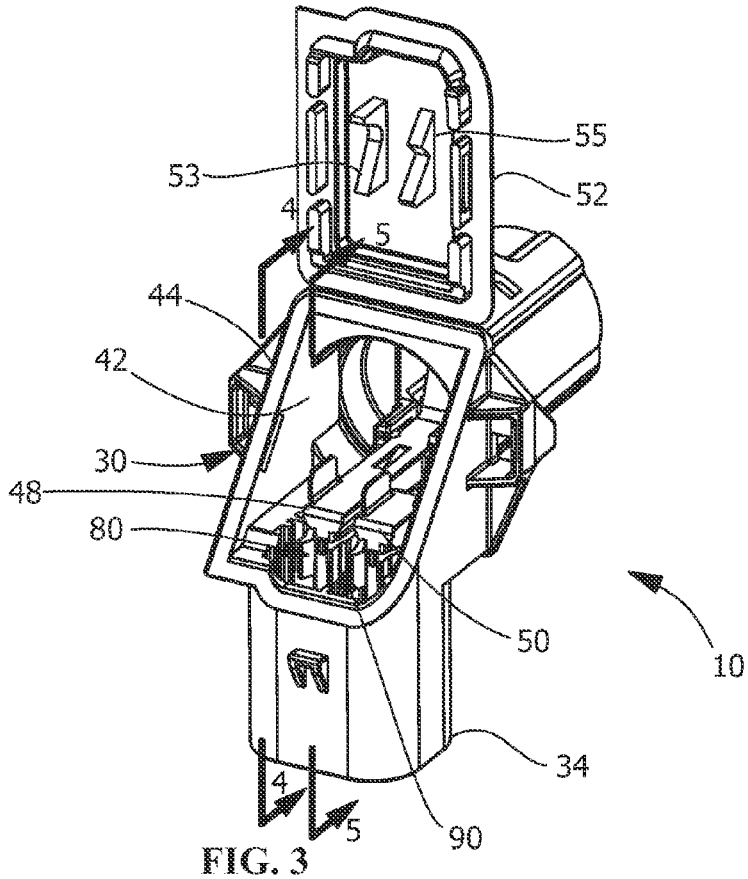
FIG. 3 is a rear perspective view of an alternate illustrative embodiment of the lamp socket assembly.
Figure 4:
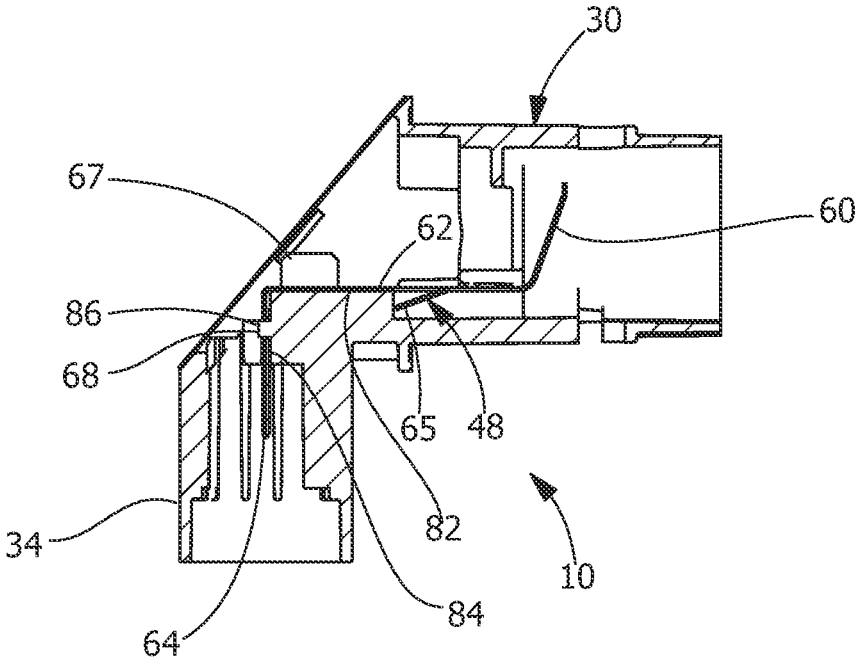
FIG. 4 is a cross-sectional view of the lamp socket assembly with a cover removed, taken along line 4-4 of FIG. 3.

Referring to FIGS. 3 and 4, terminal 48 is inserted into a first terminal receiving passage 80 of housing 30. The first terminal receiving passage 80 has a mounting portion receiving passage 82 and a contact mating portion receiving passage 84. The first terminal receiving passage 80 has surfaces which help to guide the terminal 48 into the first terminal receiving passage 80. With the terminal 48 fully inserted into the first terminal receiving passage 80, the projections 65, 66 (FIG. 2) and the tab 67 of the mounting portion 62 of the terminal 48 engage respective walls of the mounting portion receiving passage 82 to retain the mounting portion 62 in position relative to the mounting portion receiving passage 82. The cooperation of a free end of the angled contact portion 60 with a wall of the assembly 10 allows the contact portion 60 of the terminal 48 to exert a resilient contact force on the end 16 of the bulb 12 when the bulb is properly inserted into the assembly 10.

Also with the terminal 48 fully inserted into the first terminal receiving passage 80, the mounting opening 68 of the contact mating portion 64 cooperates with a projection 86 of the contact mating portion receiving passage 84 to retain the contact mating portion 64 in position relative to the contact mating portion receiving passage 84. In so doing the free end of the contact mating portion 64 is maintained in proper position to engage a mating contact of a mating connector when the mating connector is mated to the connector receiving portion 34 of the assembly 10. The use and positioning of the mounting opening 68 facilitates in providing sufficient stability and retention to properly position and maintain the free end of the contact mating portion 64 in position relative to the connector receiving portion 34 of the housing 30. No additional spacer or the like is required to insure that the free end of the contact mating portion 64 is properly positioned and secured for mating with the mating connector. While the exemplary embodiment discloses the opening 68 and projection 86, other configuration are possible, including, but not limited the member 68 being a projection and member 86 being a shoulder which engages the projection.

Figure 5:
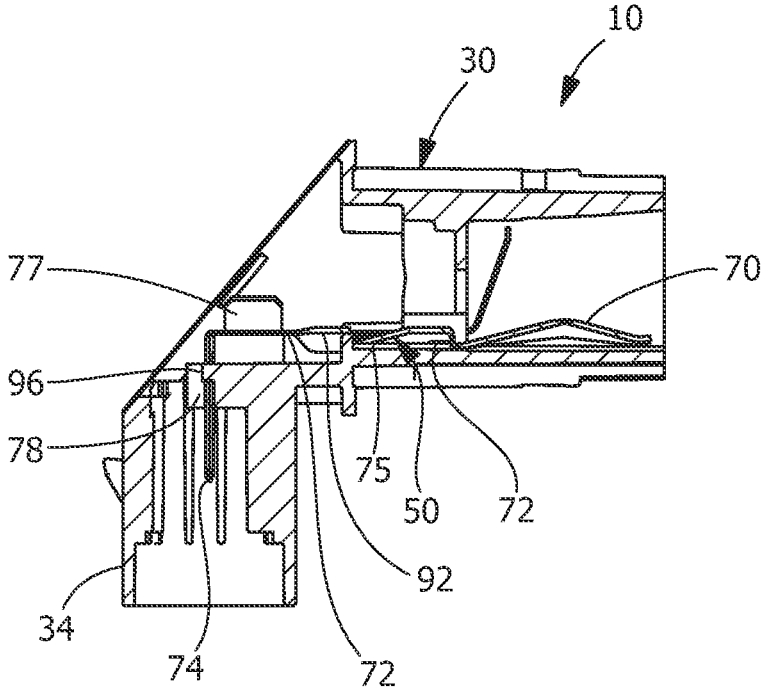
FIG. 5 is a cross-sectional view of the lamp socket assembly with the cover removed, taken along line 5-5 of FIG. 3.

Referring to FIGS. 3 and 5, terminal 50 is inserted into a second terminal receiving passage 90 of housing 30. The second terminal receiving passage 90 has a mounting portion receiving passage 92 and a contact mating portion receiving passage 94. The second terminal receiving passage 90 has surfaces which help to guide the terminal 50 into the second terminal receiving passage 90. With the terminal 50 fully inserted into the second terminal receiving passage 90, the projection 75 and the tab 77 of the mounting portion 72 of the terminal 50 engage a wall of the mounting portion receiving passage 92 to retain the mounting portion 72 in position relative to the mounting portion receiving passage 92. The cooperation of a free end of the angled contact portion 70 with a wall of the assembly 10 provides allows the contact portion 70 of the terminal 50 to exert a resilient contact force on a sidewall of the end 16 of the bulb 12 when the bulb is properly inserted into the assembly 10.

Also with the terminal 50 fully inserted into the second terminal receiving passage 90, the mounting opening 78 of the contact mating portion 74 cooperates with a projection 96 of the contact mating portion receiving passage 94 to retain the contact mating portion 74 in position relative to the contact mating portion receiving passage 94. In so doing the free end of the contact mating portion 74 is maintained in proper position to engage a mating contact of a mating connector when the mating connector is mated to the connector receiving portion 34 of the assembly 10. The use and positioning of the mounting opening 78 facilitates in providing sufficient stability and retention to properly position and maintain the free end of the contact mating portion 74 in position relative to the connector receiving portion 34 of the housing 30. No additional spacer or the like is required to insure that the free end of the contact mating portion 74 is properly positioned and secured for mating with the mating connector. While the exemplary embodiment discloses the opening 78 and projection 96, other configuration are possible, including, but not limited the member 78 being a projection and member 96 being a shoulder which engages the projection.

With terminals 48, 50 properly inserted, the cover 52 is moved into position over the opening 42 and maintained in position by adhesive 54 (FIG. 2). In this position, the projections 53, 55 cooperate with terminals 48, 50 and respective first and second terminal receiving passages 80, 90 to retain or lock the terminals 48, 50 in the terminal receiving passages 80, 90. The use and positioning of the projections 53, 55 facilitates in providing sufficient stability and retention to properly position and maintain the free end of the contact mating portions 64, 74 in position relative to the connector receiving portion 34 of the housing 30. No additional spacer or the like is required to insure that the free end of the contact mating portions 64, 74 are properly positioned and secured for mating with the mating connector.

While the written description has referred to a preferred embodiment, it will be understood by those skilled in the art that various changes and modifications may be made and equivalents may be substituted for elements thereof without departing from the patentable scope as defined by the claims. Therefore, it is intended that the patentable scope not be limited to the particular embodiments disclosed as the best mode contemplated, but rather other embodiments are intended to be within the scope of the claims if they have structural elements that do not differ from the literal language of the claims, or if they include equivalent structural elements with insubstantial differences from the literal language of the claims.

The invention claimed is:

1. A lamp socket assembly comprising:

a housing having a bulb holding portion and a connector receiving portion, an opening extending through a wall of the housing to a terminal receiving cavity;

a first terminal and a second terminal, the first terminal having a first lamp contact portion and a first contact mating portion, the second terminal having a second lamp contact portion and a second contact mating portion, the first contact mating portion of the first terminal having a first mounting member and the second contact mating section of the second terminal having a second mounting member, the first mounting member of the first contact mating portion cooperates with a first projection of a first contact mating portion receiving passage of the housing to retain the first contact mating portion in position relative to the first contact mating portion receiving passage, the second mounting member of the second contact mating portion cooperates with a second projection of a second contact mating portion receiving passage of the housing to retain the second contact mating portion in position relative to the second contact mating portion receiving passage;

a cover positioned over the opening, the cover cooperates with the housing to isolate the first and second terminals from the environmental conditions to which the lamp socket assembly is exposed;

whereby the opening is dimensioned to allow the first and second terminals to be inserted therethrough.

2. The lamp socket assembly as recited in claim 1, wherein a terminal receiving portion extends between the bulb holding portion and the connector receiving portion of the housing.

3. The lamp socket assembly as recited in claim 2, wherein the opening is provided in the terminal receiving portion, the opening extending at an angle relative to a longitudinal axis of the bulb holding portion.

4. The lamp socket assembly as recited in claim 1, wherein the first terminal has a first mounting portion which extends between the first lamp contact portion and the first contact mating portion and the second terminal has a second mounting portion which extends between the second lamp contact portion and the second contact mating portion.

5. The lamp socket assembly as recited in claim 4, wherein the first mounting portion has projections which extend from sides thereof proximate first lamp contact portion.

6. The lamp socket assembly as recited in claim 1, wherein the cover has cover projections which are provided on an inside surface of the cover, the cover projections cooperate with the first and second terminals to retain the first and second terminals in respective first and second terminal receiving passages.

7. The lamp socket assembly as recited in claim 1, wherein the cover is integrally attached to the housing.

8. The lamp socket assembly as recited in claim 1, wherein the bulb holding portion has a longitudinal axis which is essentially perpendicular to the longitudinal axis of the connector receiving portion.

9. The lamp socket assembly as recited in claim 1, wherein a seal is positioned on the bulb holding portion.

10. The lamp socket assembly as recited in claim 1, wherein the first lamp contact portion of the first terminal is a angled portion which cooperates with an end of a bulb inserted in the bulb holding portion.

11. A lamp socket assembly comprising:

a housing having a bulb holding portion and a connector receiving portion;

a first terminal and a second terminal, the first terminal having a first lamp contact portion and a first contact mating portion, the first lamp contact portion being an angled or curved portion to cooperate with an end of a lamp inserted into the bulb holding portion, the second terminal having a second lamp contact portion and a second contact mating portion, the second lamp contact portion being an angled or curved portion to cooperate with a sidewall of the lamp inserted into the bulb holding portion;

a terminal receiving portion extends between the bulb holding portion and the connector receiving portion of the housing;

an opening extending through a wall of the terminal receiving portion to a terminal receiving cavity;

whereby the opening is dimensioned to allow the first and second terminals to be inserted therethrough.

12. The lamp socket assembly as recited in claim 11, wherein the first terminal has a first mounting portion which extends between the first lamp contact portion and the first contact mating portion and the second terminal has a second mounting portion which extends between the second lamp contact portion and the second contact mating portion.

13. The lamp socket assembly as recited in claim 12, wherein the first contact mating portion of the first terminal has a first mounting opening and the second contact mating section of the second terminal has a second mounting opening, the first mounting opening of the first contact mating portion cooperates with a first projection of a first contact mating portion receiving passage of the housing to retain the first contact mating portion in position relative to the first contact mating portion receiving passage, the second mounting opening of the second contact mating portion cooperates with a second projection of a second contact mating portion receiving passage of the housing to retain the second contact mating portion in position relative to the second contact mating portion receiving passage.

14. The lamp socket assembly as recited in claim 11, wherein a cover is positioned over the opening, the cover cooperates with the housing to isolated the first and second terminals from the environmental conditions to which the lamp socket assembly is exposed, the cover has cover projections which are provided on an inside surface of the cover, the cover projections cooperate with the first and second terminals to retain the first and second terminals in respective first and second terminal receiving passages.

15. The lamp socket assembly as recited in claim 11, wherein the bulb holding portion has a longitudinal axis which is essentially perpendicular to the longitudinal axis of the connector receiving portion.

* * * * *